United States Patent [19]

Miyakawa et al.

[11] Patent Number: 4,557,856

[45] Date of Patent: Dec. 10, 1985

[54] ELECTRICALLY CONDUCTIVE COMPOSITION FOR ELECTRO-RESPONSIVE RECORDING MATERIALS

[75] Inventors: Nobuhiro Miyakawa, Kobe; Hiroshi Kokado; Eiichi Inoue, both of Tokyo, all of Japan

[73] Assignee: Mita Industrial Co., Ltd., Osaka, Japan

[21] Appl. No.: 12,289

[22] Filed: Feb. 15, 1979

[30] Foreign Application Priority Data

Feb. 18, 1978 [JP] Japan ..... 53/17118
Feb. 20, 1978 [JP] Japan ..... 53/17701

[51] Int. Cl.[4] ..... H01B 1/00

[52] U.S. Cl. ..... 252/500; 252/518; 430/56; 430/96

[58] Field of Search ..... 252/500, 62.2, 518, 252/520; 428/404; 430/31, 62, 84, 107, 56, 96

[56] References Cited

U.S. PATENT DOCUMENTS

| | | | |
|---|---|---|---|
| 3,893,935 | 7/1975 | Jadwin et al. | 252/62.1 P |
| 3,948,654 | 4/1976 | Fisher | 252/62.1 P X |
| 3,996,392 | 12/1976 | Berg et al. | 252/62.1 P X |
| 4,010,117 | 3/1977 | Maruhashi et al. | 252/500 |
| 4,011,080 | 3/1977 | McCabe | 252/500 |
| 4,135,928 | 1/1979 | Hashimoto et al. | 252/500 |
| 4,206,088 | 6/1980 | Inoue et al. | 252/500 |

*Primary Examiner*—Josephine L. Barr
*Attorney, Agent, or Firm*—Sherman & Shalloway

[57] ABSTRACT

An electrically conductive composition is disclosed, which comprises a protonically conductive compound, a finely divided inorganic solid acid and a binder, especially an aqueous emulsion type carboxyl group-containing polymer.

This composition has in combination highly improved electric conductivity, low humidity dependency, reduced tacking tendency and high whiteness and can be manufactured at a low cost. This composition is valuable for production of an electro-sensitive recording material.

27 Claims, No Drawings

ELECTRICALLY CONDUCTIVE COMPOSITION FOR ELECTRO-RESPONSIVE RECORDING MATERIALS

BACKGROUND OF THE INVENTION (1) Field of the Invention

The present invention relates to an electrically conductive composition for electro-responsive recording materials. More particularly, the invention relates to an electrically conductive composition for electro-responsive recording materials, which has in combination highly improved electric conductivity, low humidity dependency, reduced tacking tendency and high whiteness and which can be manufactured at a low cost.

By the term "electro-responsive recording material" is meant a recording material capable of performing recording in response to electric signals or performing recording by utilizing an electric energy and other energy, for example, light energy, in combination. As the recording material included in the concept of the electro-responsive recording material, there can be mentioned, for example, an electrolytic recording material, an electric discharge recording material, an electrostatic recording material and an electrophotographic photosensitive recording material. Irrespective of the image forming mechanism, in order to form a clear image promptly, it is important that each of these electro-responsive recording materials should satisfy the requirement that an appropriate electrically conductive layer should be present in the material when it is actually applied to the recording operation.

(2) Description of the Prior Art

As the conducting agent for rendering these recording materials electrically conductive, there are known various substances, for example, metal powders, carbon black, water-soluble and moisture-absorptive inorganic and organic salts, surface active agents, wetting agents such as polyhydric alcohols, and polymeric electrolytes, and these conducting agents are actually used in the art. These known conducting agents, however, have some defects or other and are still insufficient in various points.

For example, conducting agents such as metal powders and carbon black are good conductors and they have a merit that their electric conductivity is not influenced by the humidity, but they have a fatal defect that they generally have an inherent color or opacity. From the viewpoints of the sharpness and contrast of formed images, it is important that a recording material should be excellent in the whiteness, and it is generally desired that recording materials having images formed thereon may be used as originals for customary copying processes such as diazo and electrophotographic copying processes. Recording materials including a metal powder or carbon black as the conducting agent fail to meet this requirement. Moreover, the weights of recording materials of this type are heavy and they are relatively expensive.

Other conducting agents such as salts, activating agents, organic wetting agents and polymeric electrolytes are rendered electrically conductive only in the presence of water, and therefore, they inevitably involve various defects. For example, electrolytic recording materials comprising a salt or the like as the conducting agent must be used in the humidified state (wet state), and especial care should be taken to storage conditions prior to actual application. Moreover, in case of these recording materials, since recording is carried out according to a wet method, bleeding is readily caused in a formed image. Further, an electrostatic recording material or electrophotographic recording material comprising an electrically conductive layer composed of a polymeric electrolyte such as a cationic conductive resin or anionic conductive resin has a merit that it need not be used in the especially humidified state, but its electric conductivity is greatly influenced by the humidity. For example, when a recording material of this type is allowed to stand in a low humidity atmosphere for a long time, the image sharpness is drastically degraded by reduction of the electric conductivity. On the other hand, in a high humidity atmosphere, because of the water solubility of the polymer electrolyte, there is brought about a disadvantage that recording sheets readily tack each other.

SUMMARY OF THE INVENTION

We found that when a protonically conductive compound is combined with a finely divided inorganic solid acid at a specific mixing ratio and this mixture is dispersed at a specific ratio in a binder, the electric conductivity of the resulting composition is highly improved over the electric conductivity of a composition formed by dispersing the protonically conductive compound or finely divided solid acid alone in the binder, and that this three-component type composition is very valuable for production of an electrically conductive layer of an electro-responsive recording material.

We further found that this electrically conductive composition has a certain conductivity even under low humidity conditions and does not show a tacking tendency even under high humidity conditions and the composition has low humidity dependency and much reduced tacking tendency in combination, and that when this composition is used for the production of an electro-responsive recording material, a troublesome treatment such as the above-mentioned humidifying treatment need not be performed and a recording material having good touch and good adaptability to the feeding operation can be provided.

Furthermore, it was found that when an aqueous emulsion type carboxyl group-containing polymer is selected among various organic polymeric binders and the above-mentioned protonically conductive compound and finely divided inorganic solid acid are dispersed in this specific binder, there can be obtained a composition having a much improved electric conductivity.

In accordance with the present invention, there is provided an electrically conductive composition for electro-responsive recording materials, which comprises a protonically conductive compound, a finely divided inorganic solid acid and a binder, especially an aqueous emulsion type carboxyl group-containing polymer, wherein the weight ratio of the protonically conductive compound to the finely divided inorganic solid acid is in the range of from 0.5:100 to 100:100 and the amount of the binder is 10 to 500% by weight based on the total amount of the protonically conductive compound and finely divided inorganic solid acid.

When the electrically conductive composition of the present invention is used for an electro-responsive recording material, in addition to the aforementioned advantages and characteristics, there are attained various additional advantages and characteristics. For example, an electro-responsive recording material having a very excellent whiteness can be obtained. More specifically, a fine powder of a solid acid that is used in the present invention is a fine powder generally excellent in the whiteness and pigment characteristics, and a protonically conductive compound that is used in the present invention is a solid substance in which the degree of coloration is much lower than in ordinary organic bases and the like. Accordingly, when this protonically conductive compound and the finely divided inorganic solid acid are dispersed in the binder and the composition is used for formation of an electrically conductive layer, the whiteness can be remarkably improved. Further, the electrically conductive composition of the present invention, can be manufactured at a much lower cost than the manufacturing cost of a cationically conductive resin which is most excellent among conventional conducting agents, and when the composition of the present invention is used, the weight or thickness of an electrically conductive layer of the recording material can be remarkably reduced. Accordingly, the composition of the present invention is very advantageous from the economical viewpoint.

Still further, in conventional conducting agents, the conductivity is reduced as the application temperature is elevated. On the other hand, in case of the composition of the present invention, the conductivity is enhanced as the application temperature is elevated. There can be attained another advantage that the recording operation is possible even under high temperature and low humidity conditions.

Moreover, when an aqueous emulsion type carboxyl group-containing polymer is used as the binder according to a preferred embodiment of the present invention, there can be attained still another advantage that the electric conductivity is remarkably improved over the conductivity attained by any other binder.

DETAILED DESCRIPTION OF THE INVENTION

The present invention will now be described in detail.

[Protonically Conductive Compound]

In the instant specification and appended claims, by the term "protonically conductive compound" is meant a solid electrolyte in which the movable ion is a proton. This solid electrolyte has a proton as the movable ion even in the absolutely dry state, and the main difference of this solid electrolyte from ordinary solid electrolytes resides in that it shows an ionic conductivity even in the absolutely dry state.

It is preferred that the volume resistivity of the protonically conductive compound be lower than $1\times10^{13}$ Ω-cm, especially lower than $2.5\times10^{12}$ Ω-cm, in the absolutely dry state. From viewpoints of easy availability and low electric resistance, an acid addition salt of an organic base is preferred as the protonically conductive compound. However, other known protonically conductive compounds can be used in the present invention so far as the above requirement is satisfied.

A protonically conductive compound composed of an acid addition salt of an organic base that is used in the present invention is prominently advantageous over low-molecular-weight or high-molecular-weight quaternary ammonium salts which have customarily been used as conducting agents. In a conducting agent of the quaternary ammonium salt type, the movable ion is an anion present as the counter ion. On the other hand, the movable ion in the conducting agent of the present invention is a proton (hydrogen ion), and therefore, the protonically conducting compound of the present invention is excellent over the conventional quaternary ammonium salt in respect to the mobility of the ion. More specifically, in case of the conventional quaternary ammonium salt, the electric conductivity is attained for the first time only in the presence of water, but in case of the conducting agent of the present invention, the presence of water is not indispensable for manifestation of the electric conductivity.

As the organic base constituting the protonically conductive compound, there can be mentioned, for example, primary, secondary and tertiary, aliphatic, alicyclic, aromatic and heterocyclic amines, hydrazine and its derivatives, quanidine and its derivatives, and imines. These bases may be either low-molecular-weight compounds or high-molecular-weight compounds.

Suitable examples of organic bases that can be used in the present invention are shown in Table 1, though organic bases usable in the present invention are not limited to those shown in Table 1.

TABLE 1

| Compound Name | First Stage Base Dissociation Constant (pKb) | Ratio of Number of Carbon Atoms to Number of Nitrogen Atoms (C/N) |
|---|---|---|
| A. Primary Amines | | |
| Methylamine | 3.38 | 1 |
| Ethylamine | 3.37 | 2 |
| Amylamine | 3.37 | 5 |
| Cyclohexylamine | 3.36 | 6 |
| 1,2-Cyclohexane diamine | — | 3 |
| Allylamine | 3.51 | 3 |
| Hydroxylamine | 8.03 | 0 |
| Benzylamine | 3.66 | 7 |
| Ethanolamine | 4.50 | 2 |
| Ethylenedimine | 4.02 | 1 |
| Polyvinylamine | — | 2 |
| 3-Amino-1H—1,2,4-triazole | — | 0.5 |
| B. Secondary Amines | | |
| Dimethylamine | 3.13 | 2 |
| Diethylamine | 3.02 | 4 |
| Diisobutylamine | 3.50 | 8 |
| Piperidine | 2.78 | 5 |
| Piperazine | — | 2 |
| Morpholine | 5.64 | 4 |
| Pyrrolidine | 2.73 | 4 |
| Trimethylene-imine | 2.71 | 3 |
| Diallylamine | 4.71 | 6 |
| Polyethylene-imine | — | 2 |
| Hexamethylene tetra-amine | — | 1.5 |
| C. Tertiary Amines | | |
| Trimethylamine | 4.24 | 3 |
| Triethylamine | 3.35 | 6 |
| N—Ethylpiperizine | 3.6 | 7 |
| N—Methylmorpholine | 6.59 | 5 |
| Triethanolamine | 6.23 | 6 |
| 4-Aminopyridine | 4.83 | 2.5 |
| Polyvinylpyridine | — | 6 |
| D. Hydrazines | | |
| Hydrazine | 6.07 | 0 |
| Methylhydrazine | 6.13 | 0.5 |
| Ethylhydrazine | 6.29 | 1 |
| E. Guanidines | | |
| Guanidine | 0.41 | 0.33 |
| Phenylguanidine | 3.23 | 3.5 |
| Triphenylguanidine | 4.9 | 6.3 |
| Tetramethylguanidine | — | 1.3 |
| F. Heteroxyclic Amines | | |
| 2,2'-Bis-pyridine | 9.88 | 5 |
| Guanazole | — | 0.4 |
| Urazine | — | 0.67 |

TABLE 1-continued

| Compound Name | First Stage Base Dissociation Constant (pKb) | Ratio of Number of Carbon Atoms to Number of Nitrogen Atoms (C/N) |
|---|---|---|
| 6-Aminopurine | 4.20 | 1 |

It is generally preferred that the base that is used in the present invention should satisfy either of the following two requirements (i) and (ii), especially both of them: (i) the ratio of the number of carbon atoms to the number of nitrogen atoms (C/N) is within a range of from 0 to 8, especially from 1 to 4, and (ii) the first stage base dissociation constant (pKb, as determined at 20° C.) is in the range of from 0.3 to 8, especially from 2 to 6.

More specifically, according to a preferred embodiment of the present invention, by selecting and using an organic base in which the above C/N or pKb value is in the above-mentoned range, the electric conductivity of the resulting conducting agent can be remarkably enhanced over the electric conductivity of a conducting agent including an organic base having the C/N or pKb value outside the above range. The reason has not been completely elucidated but it is construed that when the C/N or pKb value is below the above range, bonding of the acid addition salt is extremely strong and dissociation of the proton becomes difficult even in an electric field, and that when the C/N or pKb value is above the above range, bonding of the acid addition salt is weakened and formation of the proton per se becomes difficult or the proton concentration is drastically lowered.

Any of inorganic and organic acids can optionally be used as the acid constituting the protonically conductive compound of the present invention. However, from the viewpoint of the electric conductivity of the final conducting agent, it is preferred to use an acid having a first stage acid dissociation constant (pKa, as measured at 25° C.) not higher than 6.5, especially not higher than 5.

Suitable examples of inorganic acids include hydrohalogenic acids such as hydrochloric acid, sulfur oxyacids such as sulfuric acid and sulfurous acid, nitrogen oxyacids such as nitric acid and nitrous acid, and phosphorus oxyacids such as ortho-phosphoric acid, meta-phosphoric acid and pyrophosphoric acid.

Suitable examples of organic acids include carboxylic acids such as formic acid, acetic acid, trichloroacetic acid, crotonic acid, glycolic acid, salicilic acid, p-hydroxybenzoic acid, oxalic acid, malonic acid, succinic acid, tartaric acid, azelaic acid, maleic acid, citric acid, pyromellitic acid and glutamic acid, sulfonic acids such as methane-sulfonic acid, benzene-sulfonic acid and p-toluene-sulfonic acid, and phosphonic acids and phosphinic acids.

As preferred acids, sulfuric acid, hydrochloric acid, phosphoric acid, nitric acid and sulfonic acid can be mentioned in the order of importance.

The acid addition salt of the organic base that is used in the present invention may be neutral, acidic or basic depending on the valency of the base or acid. Neutral, acidic or basic salts can easily be obtained by changing the reaction mole ratio between the organic base and the acid. [Finely Divided Solid Acid]

By the term "finely divided inorganic solid acid" referred to in the instant specification and appended claims is meant a fine powder of an inorganic acid having characteristics of a Bronsted acid or Lewis acid. As such inorganic solid acid, there can optionally be used any of natural, synthetic, by-product, regenerated and activated inorganic acids containing silica, alumina or aluminosilicate components. Suitable examples of the solid acid are as follows:

(A) Natural clay minerals and activated clay minerals: Montmorillonite clays such as bentonite, acid clay, fuller's earth and sub-bentonite, kaolin clays such as kaolin, and their acid-treated activated clays.

(B) Amorphous silica: Dry method amorphous silica powder commercially available under tradename "Aerosil" (product of Nippon Aerosil) and wet method amorphous silica powders commercially available under tradenames "Mizukasil" (product of Mizusawa Kagaku Kogyo), "Tokusil" (product of Tikuyama Soda) and "Syloid" (product of Fuji-Davison).

(C) Active alumina: Amorphous alumina and alumina hydrate.

(D) Compound oxides:

Silica-alumina, silica-magnesia, silica-boria.

(E) Zeolites: Natural and synthetic zeolites, especially hydrogen ion and ammonium ion substituted zeolites.

(F) Solid phosphates: Sintered products of compositions of silica or alumina and phosphoric acid.

(G) Other inorganic chemicals: Amorphous titanium oxide, titanium phosphate, zirconium phosphate.

From the viewpoints of the property of being homogeneously dispersed in the binder and of synergistic enhancement of the electric conductivity and whiteness it is important that the inorganic solid acid should be in the finely divided state. In general, it is preferred that the particle size of the inorganic solid acid be smaller than 20$\mu$, especially smaller than 10$\mu$.

From the viewpoint of synergistic enhancement of the electric conductivity, it is generally preferred that the finely divided inorganic solid acid should have an adsorptive property. More specifically, it is preferred that the BET specific surface area of the finely divided inorganic solid acid be at least 50 $m^2/g$, especially at least 100 $m^2/g$.

As the finely divided inorganic solid acid especially suitable for attaining the objects of the present invention, there can be mentioned clays, acid-treated clays, finely divided silica and hydrogen ion type zeolites.

[Binder]

As the binder for dispersing the above-mentioned protonically conductive compound and finely divided inorganic solid acid, there can be used various water-soluble, water-dispersible and organic solvent-soluble polymeric binders.

As the water-soluble binder, there can be mentioned, for example, various starches, cyanoethylated starch, methyl cellulose, ethyl cellulose, hydroxyethyl cellulose, carboxymethyl cellulose (CMC), tragacanth gum, gum arabic, glue, casein, gelatin, sodium alginate, polyvinyl alcohol, partially saponified polyvinyl acetate, partially acetalized polyvinyl alcohol, polyvinyl methyl ether, polyvinyl pyrrolidone, polyacrylamide, water-soluble acrylic resins, and mixtures thereof.

As the water-dispersible binder, there can be used, for example, aqueous emulsions and latices of polyvinyl alcohol, polyvinyl chloride, polyvinylidene chloride, vinyl chloride-vinyl acetate copolymers, styrene-butadiene copolymers, methyl methacrylate-butadiene copolymers, acrylic acid ester-styrene copolymers, polyethylene, polypropylene, ethylene-vinyl acetate copolymers, vinyl acetate-acrylic acid ester copolymers, acrylonitrile-butadiene copolymers and acrylonitrile-styrene-butadiene copolymers.

As the organic solvent-soluble binder, there can be used various natural, synthetic and semi-synthetic thermoplastic and thermosetting binders such as shellac, copal, rosin, drying oil-modified rosin, phenolic resin-modified rosin, epoxy resins, phenolic resins, amino resins, unsaturated polyester resins, silicone resins, xylene resins, bismaleimide resins, thermosetting acrylic resins, acetyl cellulose, polyvinyl acetate, polyvinyl butyral resins, thermoplastic acrylic resins, styrene-butadiene copolymers, vinyl chloride-vinyl acetate copolymers, vinyl chloride-vinyl acetate-vinyl alcohol copolymers, vinyl chloride-vinyl acetate-maleic acid copolymers, styrene-acrylic acid ester copolymers, polyamide resins, ethylene-vinyl acetate copolymers, ionomers, cyclized rubbers, and mixtures thereof.

In the present invention, in order to attain synergistic enhancement of the electric conductivity, it is preferred to select and use an emulsion of a carboxyl group-containing polymer among the foregoing various binders.

Binders composed of water-soluble polymers or emulsions of water-dispersible polymers have been used as the binder for formation of an electrically conductive layer. In the case where an aqueous emulsion type carboxyl group-containing polymer is used as the binder for dispersing the protonically conductive compound and finely divided inorganic solid acid is used according to the preferred embodiment of the present invention, as will be apparent from Examples given hereinafter, in case of, for example, an aqueous emulsion of a water-soluble polymer (polyvinyl alcohol), the volume resistivity is $5.2\times10^8$ Ω-cm or in case of an aqueous emulsion of other polymer (polyvinyl acetate) the volume resistivity is $2.5\times10^8$ Ω-cm, while the volume resistivity is $6.1\times10^6$ Ω-cm in case of an aqueous emulsion type carboxyl group-containing polymer. Accordingly, it is apparent that the electric conductivity can be remarkably improved according to the above-mentioned preferred embodiment of the present invention.

The reason of this remarkable enhancement of the electric conductivity is not precisely elucidated. In case of a water-soluble polymer, it is considered that a continuous coating film surrounding the dispersed phase is formed and it acts as a barrier to the movable ion (proton). On the other hand, in the case of the binder of the present invention, it is believed that such continuous coating film acting as a barrier is hardly formed and the contained carboxyl group acts as the charge carrier site and promotes dissociation of the proton.

In this preferred embodiment of the present invention, it is preferred that the carboxyl group content in the carboxyl group-containing polymer used be such that the acid value is from 1 to 30, especially from 5 to 20.

When the acid value is larger than 30, the water-soluble characteristic of the polymer is prominent and the above-mentioned disadvantage of a water-soluble polymer is brought about. When the acid value is smaller than 1, the intended synergistic enhancement of the electric conductivity cannot be attained.

The carboxyl group-containing polymer that is used in the preferred embodiment of the present invention may be prepared by random- or block-copolymerizing an ethylenically unsaturated carboxylic acid or anhydride thereof with other ethylenically unsaturated monomer or by graft-polymerizing an ethylenically unsaturated carboxylic acid or anhydride thereof to a polymer of other ethylenically unsaturated monomer. An aqueous emulsion of a carboxyl group-containing polymer may be formed by carrying out such random or block copolymerization or graft polymerization according to the so-called emulsion polymerization technique. Further, an aqueous emulsion of the polymer may be formed by self-emulsifying a preformed copolymer or graft polymer with an ammonium salt or by emulsifying such copolymer or graft polymer with heat or a solvent in combination with a surface active agent.

As the ethylenically unsaturated carboxylic acid, there can be used, for example, acrylic acid, methacrylic acid, crotonic acid, maleic anhydride, fumaric acid, itaconic acid, aconitic acid, atropic acid, cinnamic acid, citraconic acid, mesaconic acid and mixtures thereof.

As the monomer copolymerizable with such ethylenically unsaturated carboxylic acid, there can be mentioned, for example, olefins such as ethylene and propylene, diolefins such as butadiene, isoprene and chloroprene, vinyl aromatic compounds such as styrene, vinyltoluene and α-methylstyrene, vinyl esters such as vinyl acetate, vinyl formate and vinyl propionate, vinyl halide monomers such as vinyl chloride, vinylidene chloride and vinyl fluoride, acryl esters such as ethyl acrylate, methyl methacrylate, 2-ethylhexyl acrylate and 3-hydroxypropyl acrylate, ethylenically unsaturated nitriles such as acrylonitrile and methacrylontrile, and nitrogen-containing vinyl compounds such as vinyl pyridine, N-vinyl pyrrolidone, vinyl carbazole and acrylamide. These monomers may be used singly or in the form of a mixture of two or more of them.

As the preferred carbonyl group-containing polymer that is used in the form of an aqueous emulsion, there can be mentioned, for example, an acrylic acid-butadiene copolymer, an acrylic acid-styrene-butadiene copolymer, a maleic acid-methyl methacrylate-butadiene copolymer, a crotonic acid-acrylonitrile-butadiene copolymer, a methacrylic acid-ethylene-vinyl chloride copolymer, an itaconic acid-styrene-butadiene copolymer, an acrylic acid-vinyl acetate copolymer, a methacrylic acid-ethyl acrylate-styrene copolymer, a maleic acid-ethylene-vinyl acetate copolymer, a methacrylic acid-ethyl acrylate-vinyl acetate copolymer, a crotonic acid-vinyl toluene-butadiene copolymer, a methacrylic acid-methyl methacrylate-styrene copolymer and an acrylic acid-ethylene-vinyl acetate copolymer.

[Electrically Conductive Composition]

In the present invention, it is important that the protonically conductive compound (A) should be combined with the finely divided inorganic solid acid (B) at an (A)/(B) mixing weight ratio ranging from 0.5/100 to 100/100, preferably from 2/100 to 80/100, especially preferably from 5/100 to 50/100.

For example, when tetramethylquanidine sulfate alone is dispersed as the protonically conductive compound (A) in a binder, the volume resistivity of the resulting composition is $3.3\times10^9$ Ω-cm, and when kaolin alone is dispersed as the finely divided inorganic solid acid in a binder, the volume resistivity of the composition is $2.0\times10^{11}$ Ω-cm. On the other hand, when both are dispersed in a binder, the volume resistivity of the resulting composition is as low as $1.0\times10^8$ Ω-cm. In other words, when both the protonically conductive compound (A) and the finely divided inorganic solid acid (B) are used in combination according to the present invention, the electric conductivity is about 33 times the electric conductivity attained by the single use of the compound (A) or about 2000 times the electric conductivity attained by the single use of the solid acid (B). This fact indicates that the protonically conductive compound and the inorganic solid acid do not act independently as the conducting agents but they exert a synergistic effect in highly improving the electric conductivity.

When the mixing ratio between the protonically conductive compound (A) and the finely divided inorganic solid acid (B) is outside the above-mentioned range, attainment of the above-mentioned synergistic enhancement of the electric conductivity cannot be expected. When the amount of the compound (A) is too large, there are often caused such disadvantages as manifestation of the saturation state of the electric conductivity in the composition, loss of the bonding characteristic of the composition and prominent tacking phenomenon of the coating formed from the resulting composition. On the other hand, when the amount of the solid acid (B) is too large, the absolute volume resistance of the composition is increased or the humidity dependency of the electric conductivity is increased, and therefore, the intended objects of the present invention cannot be attained.

The amount used of the binder is changed depending on whether the electrically conductive composition is used as an electrically conductive substrate layer of an electro-sensitive recording material or an an electrically conductive recording layer. However, it is ordinarily preferred that the binder (C) be used in an amount of 10 to 500% by weight based on the total amount of the protonically conductive compound (A) and the finely divided inorganic solid acid (B). It is especially preferred that in case of an electrically conductive substrate, the binder (C) be used in an amount of 10 to 500% by weight based on the total amount of the components (A) and (B) and in case of an electrically conductive recording layer, the binder (C) be used in an amount of 20 to 100% by weight based on the total amount of the components (A) and (B). When the amount of the binder (C) is too small, the electric conductivity is saturated and the bonding characteristic of the composition is drastically reduced. When the amount of the binder (C) is too large, the electric conductivity is drastically reduced and the humidity dependency of the electric conductivity is increased. Therefore, it is important that the binder (C) should be used in an amount included in the above-mentioned range.

Various known conducting agents and assistants, for example, polyhydric alcohols, water-soluble inorganic salts and the like, may be incorporated in the electrically conductive composition of the present invention if desired, though it is ordinarily unnecessary to use such additives.

[Electrically Conductive Substrate]

The electrically conductive composition of the present invention can be advantageously used for production of an electrically conductive substrate of an electrostatic recording paper, an electrophotographic photo-sensitive paper or the like.

Such electrically conductive substrate can be prepared by coating or impregnating at least one surface of a paper substrate with the composition of the present invention or by incorporating the composition of the present invention into a paper-forming material at the paper-manufacturing step. It is ordinarily preferred that the amount coated of the electrically conductive composition be 3 to 50 g/m$^2$, preferably 5 to 30 g/m$^2$, though the preferred amount coated varies to some extent depending on the required degree of the electric conductivity.

A coating liquid of the electrically conductive composition of the present invention can easily be prepared, for example, by dissolving the protonically conductive compound (A) in water, dispersing the finely divided solid acid (B) uniformly in the resulting solution and incorporating the dispersion into a solution of a water-soluble binder (C) or an aqueous emulsion or latex of a water-dispersible binder (C). When the binder is used in the form of solution in an organic solvent, the protonically conductive compound and finely divided solid acid are added to this solution and they are uniformly dispersed by milling in a ball mill or the like, whereby a coating composition can be prepared. From the viewpoint of adaptability to the coating operation, it is preferred that the solid concentration in such coating liquid be 10 to 60%, especially 25 to 50%.

A known dielectric layer or photoconductive layer is formed on the so formed electrically conductive substrate, whereby an electrostatic recording paper, an electrophotographic photosensitive paper or the like is formed.

When the binder (C) is composed of an aqueous emulsion of the carboxyl group-containing polymer, in order to impart an organic solvent resistance necessary at the step of forming a dielectric layer or photoconductive layer on the so formed electrically conductive layer, it is possible to incorporate in the electrically conductive composition of the preferred embodiment of the present invention a water-soluble polymer in an amount not degrading the characteristics of the electrically conductive composition, for example, up to 60% by weight based on the carboxyl group-containing polymer.

As such water-soluble polymer, there can be mentioned, for example, various starches, cyanoethylated starch, methyl cellulose, ethyl cellulose, hydroxyethyl cellulose, carboxymethyl cellulose (CMC), tragacanth gum, gum arabic, glue, casein, gelatin, sodium alginate, polyvinyl alcohol, partially saponified polyvinyl acetate, partially acetalized polyvinyl alcohol, polyvinyl methyl ether, polyvinyl pyrrolidone, polyacrylamide and water-soluble acrylic resins. These water-soluble polymers may be used singly or in the form of a mixture of two or more of them.

In order to attain the same object as mentioned above, a crosslinking agent or insolubilizing agent capable of reacting with carboxyl groups to insolubilize at least the surface of the coating of the electrically conductive composition may be incorporated in the electrically conductive composition or impregnated in the formed coating of the electrically conductive composition in an amount not degrading the characteristics of the electric conductive composition, for example, up to 10% by weight based on the carboxyl group-containing polymer.

As such crosslinking or insolubilizing agent, there can be mentioned, for example, a melamine resin, a urea resin, glyoxal, glutaraldehyde, a melamine-formalin resin, a specifically modified polyamide resin, formaldehyde, a urea-formalin resin, a triazone resin, an alkyl ketene dimer, an epoxy resin, and salts and oxides of polyvalent metals (such as chromium, zirconium, antimony, aluminum, tin and zinc).

[Electrically Conductive Recording Layer]

The electrically conductive composition of the present invention can be advantageously used for formation of an electrically conductive recording layer of an electrolytic recording paper.

As the coloration mechanism in the electrolytic recording, there are known the following 5 kinds of the coloration mechanisms, and the electrically conductive composition of the present invention can be applied to any of these coloration mechanisms:

(a) Introduction of different ions into the recording layer.

(b) Discharge of ions at an electrode falling in contact with the recording layer.

(c) Oxidation or reduction on the surface of an electrode falling in contact with the recording layer.

(d) Increase of the concentration of specific ions (change of the pH) on the surface of an electrode falling in contact with the recording layer.

(e) Joule's heat generated in the recording layer (heat-sensitive coloration).

The above-mentioned coloration mechanism is further divided into the following three types:

(1) A metal stylus as anode is dissolved out in the form of a cation into the electrically conductive substrate by electrode reaction, and it reacts with a color former contained in the electroconductive substrate, which consists of a chelating agent, to form a color image of a chelate compound.

(2) A metal stylus as anode is dissolved out in the form of a cation into the electrically conductive substrate by electrode reaction and is reduced by a reducing agent contained in the electroconductive substrate to form an image of fine metal particles.

(3) A stylus of a metal such as tellurium as cathode is dissolved out in the form of an anion into the electrically conductive substrate by electrode reaction and the formed compound is subsequently decomposed to form an image of fine metal particles.

Typical instances of combinations of metal electrodes and color formers to be used in the color formation mechanism (a) are as shown in Table 2.

TABLE 2

| Metal Electrode and Polarity | Color Former | Coloring Substance and Color Thereof | Type |
|---|---|---|---|
| Fe, anode | sodium diethyldithiocarbamate | chelate compound violet | (1) |
| Fe, anode | potassium ferrocyanide | complex compound, blue | (1) |
| Fe, anode | tannic acid | chelate compound, violet | (1) |
| Fe, anode | catechol | chelate compound, black | (1) |
| Cu, anode | rubeanic acid | chelate compound, greenich black | (1) |
| Ag, anode | formaldehyde sulfoxylate | reduction product of Ag ion (metallic silver), black | (2) |
| Te, cathode | sodium chloride | Te simple substance formed by decomposition of $Na_2Te$ and $H_2Te$, black | (3) |

As another examples of combinations of metals and color formers (chelating agents) belonging to the type (1), the following can be mentioned:

Ag: polyhydric phenol compounds, galloylgallic acid, chromotropic acid

Fe: 2,2',2''-terpyridine, nitroso R salt, hydroquinone, benzoylpyridine oxime

Cu: sodium ethylenediamine tetraacetate, rubeanic acid, sodium diethyldithiocarbamate, neocuproine Ni: sodium diethyldithiocarbamate, nitroso R salt A typical instance of the color formation mechanism (b) is as follows:

| Polarity of Metal Stylus Electrode | Color Former | Coloring Substance and Color Thereof |
|---|---|---|
| anode | potassium iodide and starch | iodine-starch reaction product, deep blue |

Suitable examples of the color formation mechanism (c) are as follows:

| Polarity of Metal Stylus Electrode | Color Former | Coloring Substance and Color Thereof |
|---|---|---|
| [oxidation type] anode | Leuco Crystal Violet | Crystal Violet, Violet |
| [reduction type] cathode | 2,3,5-triphenyltetrazolium chloride | formazan dye, red |

As the color former of the oxidation type, in addition to the above compound, there can be used various leuco dyes, such as Leucoethyl Nile Blue (blue), Leucomethyl Capryl Blue (blue), Leuco Toluine Blue (violet), leucodiphenylamine (violet), leuco-N-methyldiphenylamine-p-sulfonic acid (reddish violet), leucophenylanthranylic acid (reddish violet), methylviologen (violet), Leuco Safranine T (red), leuco-indigo-sulfonic acid (blue), leucophenosafranine (red), Leucomethylene Blue (blue), leucodiphenyl benzidine, Leuco Auramine (yellow), Benzoyl Leucomethylene blue (blue), Leuco Erioglaucine A (yellowish green to red), leuco-p-nitrodiphenylamine (violet) and leuco-diphenylamine-0,0'-diphenylcarboxylic acid (bluish violet).

As the color former of the reduction type, in addition to 2,3,5-triphenyltetrazolium chloride, there can be employed, for example, Tetrazolium Blue, Tetrazolium Purple, Tetrazolium Violet, 2,5-diphenyl-3-(4-styrylphenyl)tetrazolium chloride and metal componds such as phospho-tungstic acid, phospho-molybdic acid and ammonium phospho-molybdate.

Suitable examples of the color formation mechanism (d) are shown in Table 3.

TABLE 3

| Polarity of Metal Stylus Electrode | Color Former | Coloring Substance and Color Thereof |
|---|---|---|
| cathode | diazonium salt | dimer of diazonium salt decomposition product, orange to black |
| cathode | aromatic primary amine, coupling component and alkali metal nitrate conductive electrolyte | formed azo dye, blackish brown |

As the diazonium salt, there can be employed diazonium salts customarily used in ordinary diazo type reproduction process, for example, p-N,N-dimethylaminobenzene diazonium chloride/zinc chloride double salt, 4-morpholinobenzene diazonium chloride/zinc chloride double salt, and p-N,N-diethylamino-2,5-dimethoxybenzene diazonium chloride/zinc chloride double salt.

As the aromatic primary amine mentioned as one component of the latter color former in Table 3, there can be used amines customarily employed for synthesis of diazonium compounds for diazo type reproduction, such as aniline, morpholine and N,N-di-substituted-p-phenylene diamines. These amines are usually employed in the form of hydrochlorides. As the coupling component, there can be used phenol derivatives, hydroxynaphthalene derivatives and active methylene-containing compounds.

Suitable examples of the coloration mechanism are shown in Table 4.

TABLE 4

| Color Former | Color Developer |
|---|---|
| leuco dyes | organic acidic substances |
| metal salts of long-chain fatty acids | phenols |
| metal salts of organic acids | metal sulfides, organic chelating agents |
| noble metal salts of organic acids | aromatic organic reducing agents |
| metal salts of higher fatty acids | zinc derivatives of di-substituted dithiocarbamic acid |

In this case, it is necessary that the solvent of the binder should not dissolve such color former or color developer. Accordingly, the binder, color former and color developer are appropriately selected so that this requirement is satisfied.

In the present invention, the above-mentioned color former, optionally with the color developer, is incorporated in the electrically conductive composition in an amount enough to form an image having a sufficient density, namely in an amount of 2 to 40% by weight, particularly 5 to 35% by weight, based on the total amount of the protonically conductive compound (A), finely divided solid acid (B) and binder (C).

In order to stabilize the color former and color developer in the composition, it is possible to incorporate known stabilizers, for exaple, urea type stabilizers such as thiourea and its alkyl derivatives, oxidizing agents such as alkali metal salts of chloric acid and perchloric acid, acidifying agents such as formic acid, oxalic acid, hydrochloric acid and citric acid, and alkaline buffer agents such as alkali metal and alkaline earth metal salts of formic acid, acetic acid, carbonic acid, tartaric acid, bicarbonic acid, boric acid and phosphoric acid.

The composition for formation of such electrically conductive recording layer can be prepared in the same manner as in the case of the above-mentioned coating composition for formation of an electrically conductive substrate, except that a color former, optionally with a color developer, is further incorporated.

The composition may be coated on a substrate such as a paper substrate, a paper substrate which has been subjected to an electrically conductive treatment, a metal foil, a metal-laminated paper, a metal-vacuum-deposited paper or a film in an amount of 3 to 50 g/m$^2$, especially 5 to 25 g/m$^2$.

The electrically conductive composition of the present invention can be used especially advantageously for formation of a reduction type recording layer of the above-mentioned coloration mechanism (c) using a tetrazolium salt as the color former. In the composition of the present invention, since the movable ion is a proton, reduction of the color former on the cathode can be performed very effectively, and a recorded image having much higher density and contrast than those of images formed according to the conventional techniques can be formed.

The electrically conductive composition of the present invention has a very high electric conductivity that cannot be expected from the electric conductivity of a composition comprising a finely divided inorganic solid acid or protonically conductive compound alone, and the humidity dependency of this high electric conductivity is much lower than the humidity dependency of the electric conductivity in known inorganic salt conducting agents or organic conducting agents. The electrically conductive composition of the present invention has a high electric conductivity even under low humidity conditions and manifests no substantial tacking tendency even under high humidity conditions. Moreover, the electrically conductive composition of the present invention is especially excellent in the whiteness and smoothness of the coating, and when this composition is employed, an excellent electro-responsive recording material can be provided at a relatively low cost. These are advantages of the present invention over the prior art techniques.

The present invention will now be described in detail by reference to the following Examples that by no means limit the scope of the invention.

Incidentally, in these Examples, all of "parts" and "%" are by weight.

EXAMPLE 1

In a ball mill, 50 parts of a 20% solution of a vinyl chloride-vinyl acetate-vinyl alcohol copolymer (S-lec A manufactured by Sekisui Kagaku Kogyo) in tetrahydrofuran, 20 parts of kaolin, 4 parts of tetramethylguanidine sulfate and 30 parts of tetrahydrofuran were subjected to the milling treatment for 20 hours. The resulting dispersion was coated on high quality paper in an amount of 10 g/m$^2$ (as measured in the dry state) by using a wire bar and dried to obtain an electrically conductive paper. The resulting electrically conductive paper had a surface resistance of $6.1 \times 10^7\ \Omega$ as measured at a temperature of 14° C. and a relative humidity of 54%. In the same manner as described above, the composition was coated and dried on an aluminum foil. For comparison, a composition free of kaolin or tetramethylguanidine sulfate was similarly coated and dried on an aluminum foil. With respect to each of samples of coated aluminum foils, the volume resistivity was determined at a temperature of 24° C. and a relative humidity of 60% to obtain results shown in Table 5.

TABLE 5

| Binder | Kaolin | Tetramethylguanidine Sulfate | Volume Resistivity (Ω-cm) |
|---|---|---|---|
| added | not added | not added | $1.0 \times 10^{14}$ |
| added | added | not added | $2.0 \times 10^{11}$ |
| added | not added | added | $3.3 \times 10^{9}$ |
| added | added | added | $1.0 \times 10^{8}$ |

From the results shown in Table 5, it will readily be understood that the electric conductivity can be synergistically improved by incorporation of kaolin and tetramethylguanidine sulfate in combination.

EXAMPLE 2

| | |
|---|---|
| Activated clay | 30 parts |
| Piperazine sulfate | 6 parts |
| Polyvinyl acetate emulsion (Nikkasol H-07, 50% solution, manufactured by Nippon Carbide Kogyo) | 12 parts |
| Oxidized starch | 5 parts |
| Melame-formaldehyde resin Sumirez Resin 613 manufactured by Sumitomo Kagaku) | 0.7 part |
| Water | 150 parts |

The above components were milled for 10 hours in a ball mill, and the resulting composition was coated on both the surfaces of high quality paper having a thickness of 80μ by a wire bar so that the amount coated was 5 g/m$^2$ (as measured in the dry state) on each surface, and the coated composition was dried to obtain an electrically conductive paper, which had a surface resistance of $1.5\times10^8$ Ω as measured at a temperature of 20° C. and a relative humidity of 40%. Lithopone was added to an acrylic resin (Dianal LR-297 manufactured by Mitsubishi Rayon) in an amount of 10% based on the solids of the resin, and the mixture was pulverized and blended to form a coating liquid. Then, the coating liquid was coated and dried on one surface of the above-mentioned electrically conductive paper in such an amount as forming a coating having a thickness of about 10μ, whereby an electrostatic recording paper was prepared. The recording operation was carried out on this recording paper by applying a direct current voltage of −600 V under conditions of a line density of 6 lines per millimeter, a recording speed of 2 m/sec and a pulse width of 20 μS, and development was carried out by using a dry-type positive two-component developer (manufactured by Mita Industrial Co., Ltd.) and fixation was conducted under heating. The reflection density of the recorded image area was determined by a densitometer (Sakura Micro-Densitometer PDM-5 manufactured by Kinishiroku Shashin Kogyo). It was found that the reflection density was 1.5.

EXAMPLE 3

In the same manner as described in Example 2, a coating compostion was formed by pulverizing and mixing 30 parts of a hydrogen ion type zeolite, 3 parts of hexamethylenetetramine methane-sulfonate, 75 parts of a 10% aqueous solution of polyvinyl alcohol and 50 parts of water and was coated on high quality paper to obtain an electrically conductive paper, which had a surface resistance of $8.9\times10^7$ Ω as measured at a temperature of 20° C. and a relative humidity of 20%. When hexamethylene-tetramine methane-sulfonate was not added, the surface resistance of the resulting comparative electrically conductive paper was $3.6\times10^8$ Ω as measured under the same conditions. A photosensitive layer comprising zinc oxide (SOX 500 manufactured by Seido Kagaku), a sensitizing dye (Bromophenol Blue) and an acrylic resin (Azotap 3211 manufactured by Nisshoku Arrow) was coated in a thickness of 8μ on the above-mentioned electrically conductive paper according to customary procedures to obtain a photosensitive paper for electrophotography. When the copying operation was carried out by using this photosensitive paper in a dry type electrophotographic copying machine (Model 900-D manufactured by Mita Industrial Co., Ltd.), a sharp image having a high contrast but being free of fog was obtained.

The hydrogen ion type zeolite used as prepared by substituting a zeolite of 13X type with an ammonium ion and then heating it in vacuo.

EXAMPLE 4

In the same manner as described in Example 2, 50 parts of a fine powder of amorphous silica (manufactured by Mizusawa Kagaku), 10 parts of cyclohexylamine trichloroacetate, 25 parts of a styrene-butadiene copolymer (48% solution, manufactured by Dow Chemical) and 400 parts of water were pulverized and mixed in a ball mill and the resulting composition was coated on high quality paper to form an electrically conductive paper, which had a surface resistance of $1.3\times10^8$ Ω as measured at a temperature of 30° C. and a relative humidity of 20% and $6.5\times10^6$ Ω as measured at a temperature of 20° C. and a relative humidity of 80%.

EXAMPLE 5

In a ball mill, 50 parts of kaolin, 20 parts of tetramethylguanidine sulfate, 40 parts of a methyl methacrylate-styrene copolymer (48% aqueous solution, manufactured by Takeda Yakuhin Kogyo) and 170 parts of water were milled for 10 hours, and 5 parts of Benzoyl Leucomethylene Blue was added and the mixture was further milled for 5 hours. The resulting dispersion was coated on an aluminum-laminated paper and dried to form an electrically conductive recording layer having a thickness of 11μ. This recording paper was wound and stuck to a metal drum and the recording operation was carried out by using the aluminum layer as the cathode and a metal stylus (formed of tungsten; 150μ in diameter) as the anode under the following conditions; namely, a recording speed of 1.2 m/sec, a line density of 3.85 lines per millimeter, a stylus weight of 10 g and a recording voltage of +200 V. A recorded image having a reflection density of 0.45 (a red filter was used) was obtained.

EXAMPLE 6

Procedures of Example 5 were repeated in the same manner except that 2,3,5-triphenyltetrazolium chloride, Tetrazolium Blue or Neotetrazolium Chloride was used instead of Benzoyl Leucomethylene Blue and a voltage of −200 V was applied to the metal stylus. A recorded image of a red, blue or violet color was obtained.

EXAMPLE 7

Polyvinyl alcohol (Gosenol GL-05 manufactured by Nippon Gosei Kagaku Kogyo), a polyvinyl acetate emulsion (Movinyl 550 manufactured by Hoechst AG) or an emulsion of an acrylic acid-styrene-butadiene copolymer (acid value=12.5) was used as the binder. Namely, 30 parts (as the solid) of the binder was added to 100 parts of kaolin (finely divided inorganic solid acid) and 30 parts of hexamethylene-tetramine methane-sulfonate (protonically conductive compound) and an appropriate amount of water was further added. The mixture was pulverized and blended for 20 hours in a ball mill, and the resulting dispersion was coated on an aluminum foil having a thickness of 50μ by a wire bar and dried at 60° C. for 20 minutes. Then, the coated aluminum foil was allowed to stand still in an atmosphere maintained at a temperature of 14° C. and a relative humidity of 54% for 2 hours, and the volume resistivity was measured to obtain results shown in Table 6.

TABLE 6

| Binder | Coating Thickness (μ) | Volume Resistivity (Ω-cm) |
|---|---|---|
| polyvinyl alcohol | 10 | $5.2 \times 10^8$ |
| polyvinyl acetate emulsion | 20 | $2.5 \times 10^8$ |
| carboxyl group-containing polymer emulsion | 18 | $6.1 \times 10^6$ |

EXAMPLE 8

| | |
|---|---|
| Bentonite | 10 parts |
| Gaunidine sulfate | 0.1 part |
| Maleic acid-styrene-butadiene copolymer emulsion (50% solution, acid value = 7.3) | 5 parts |
| Water | 80 parts |

The above components were pulverized and mixed for 20 hours in a ball mill, and the resulting dispersion was coated on art paper having a thickness of 80μ by a wire bar and dried to form an electrically conductive layer [sample (a)]. Separately, a dispersion was similarly prepared without using guanidine sulfate [sample (b)] or by using a styrene-butadiene copolymer free of maleic acid as the binder [sample (c)] and the dispersion was coated and dried in the same manner as described above. The surface resistance of each sample was measured to obtain results shown in Table 7.

TABLE 7

| Sample | Surface Resistance (Ω) temperature of 35° C. and relative humidity of 20% | temperature of 20° C. and relative humidity of 80% |
|---|---|---|
| (a) | $7.9 \times 10^7$ | $1.5 \times 10^6$ |
| (b) | $4.8 \times 10^8$ | $2.6 \times 10^6$ |
| (c) | $1.0 \times 10^8$ | $3.0 \times 10^6$ |

EXAMPLE 9

In a ball mill, 30 parts of acid clay, 5 parts of cyclohexylamine sulfate, 18 parts of a crotonic acid-vinyl acetate copolymer emulsion (50% solution, acid value=10), 4 parts of oxidized starch and 100 parts of water were pulverized and mixed for 10 hours, and 0.25 part of a melamine-formalin resin (Sumirez Resin 613 manufactured by Sumitomo Kagaku) was added to the mixture. Then, the resulting composition was sufficiently agitated, and it was coated and dried on both surfaces of high quality paper so that the amount coated was 5 g/m$^2$ on each surface, whereby an electrically conductive paper was obtained.

The so obtained electrically conductive paper had a surface resistance of $8.9 \times 10^7$ Ω as measured at a temperature of 20° C. and a relative humidity of 40%.

Lithopone was added to an acryl resin (Dianal LR-297 manufactured by Mitsubishi Rayon) in an amount of 10% based on the solids of the resin, and the mixture was pulverized and mixed. The resulting coating composition was coated and dried on one surface of the above-mentioned electrically conductive paper so that the thickness of the coating layer was about 10μ as measured in the dry state, whereby an electrostatic recording paper was obtained. The recording operation was carried out on this recording paper by applying a direct current voltage of −600 V at a line density of 6 lines per millimeter, a recording speed of 2 m/sec and a pulse width of 20 μS. Then, development was carried out by using a dry type positive two-component developer (manufactured by Mita Industrial Co. Ltd.) and fixation was conducted under heating. The reflection density of the recorded image area was measured by using a densitometer (Sakura Micro-Densitometer PDM-5 manufactured by Konishiroku Shashin Kogyo). It was found that the reflection density was 1.5.

EXAMPLE 10

A dispersion obtained by pulverizing and mixing 50 parts of a fine powder of amorphous silica (manufactured by Mizusawa Kagaku), 5 parts of 1,6-diaminocyclohexane trichloroacetate, 20 parts of a methacrylic acid-ethylene-vinyl chloride copolymer emulsion (45% solution, acid value=20.7), 20 parts of a 10% aqueous solution of polyvinyl alcohol and 250 parts of water was coated and dried on both the surfaces of high quality paper so that the amount coated was 6 g/m$^2$ on each surface, whereby an electrically conductive paper was obtained. The surface resistance of the so obtained electrically conductive paper was $6.3 \times 10^7$ Ω as measured at a temperature of 16° C. and a relative humidity of 44%. Then, a photosensitive layer comprising zinc oxide (Sazex 4000 manufactured by Sakai Kagaku), a sensitizing dye (Bromophenol Blue) and a binder (acrylic resin Dianal FR-80 manufactured by Mitsubishi Rayon) was formed in a thickness of 10μ on the surface of the above-mentioned electrically conductive paper according to customary procedures to obtain a photosensitive paper. The copying operation was carried out by using this photosensitive paper in a dry type photocopying machine (Model 900-D manufactured by Mita Industrial Co., Ltd.). A copy having a sharp image having a high contrast but being free of fog was obtained.

EXAMPLE 11

| | |
|---|---|
| Kaolin | 30 parts |
| Titanium oxide (rutile) | 9 parts |
| Tetramethylguanidine sulfate | 12 parts |
| Methacrylic acid-methyl methacrylate-styrene copolymer emulsion (55% solution, acid value = 6.6) | 20 parts |
| Water | 120 parts |

The above components were pulverized and mixed for 10 hours in a ball mill, and 3 parts of Benzoyl Leucomethylene Blue as a leuco dye was further added and milling was conducted for 5 hours.

The resulting dispersion was coated on an aluminum-vacuum-deposited paper by a wire bar and dried to obtain a recording paper having an electrically conductive recording layer having a thickness of 15μ. The recording operation was carried out by using the so obtained paper as a dry type electrolytic recording paper under conditions described below to obtain a blue recorded image having a reflection density of 0.72 (a red filter was used). Recording Conditions:

Temperature: 12° C.
Relative humidity: 58.5%
Recording speed: 1.2 m/sec
Line density: 3.85 lines per millimeter
Stylus weight: 10 g
Recording voltage: +200 V For comparison, 30 parts of a cationic conductive resin (ECR-34, 33.5% aqueous solution, manufactured by Dow Chemical) was used for production of a recording paper instead of theabove-mentioned binder and protonically conductive compound of the present invention, and the recording operation was conducted in the same manner by using the so prepared recording paper. The reflection density of the recorded image was 0.40.

EXAMPLE 12

A recording paper was prepared in the same manner as in Example 11 except that Leuco Malachite Green or Leuco Crystal Violet was used instead of the leuco dye used in Example 11, and the recording operation was carried out by using this recording paper to obtain a green or bluish violet recorded image having a reflection density of 0.68 or 0.70.

EXAMPLE 13

| | |
|---|---|
| Hydrogen ion type zeolite | 30 parts |
| Titanium oxide (rutile) | 10 parts |
| Diaminopropane sulfate | 12 parts |
| Acrylic acid-ethylene-vinyl acetate copolymer emulsion (45% solution, acid value = 14.6) | 28 parts |
| Water | 110 parts |

The above components were pulverized and mixed in a ball mill for 15 hours, and 3 parts of 2,3,5-triphenyltetrazolium chloride was further added and milling was conducted for 30 minutes. The resulting dispersion was coated and dried on a carbon-treated, electrically conductive polyester film having a thickness of 80$\mu$ and a surface resistance of $3\times10^3$ $\Omega$, to form an electrically conductive recording layer having a thickness of 16$\mu$. By using the so obtained recording material, the dry type electrolytic recording operation was carried out in the same manner as in Example 11 excepr that the applied recording voltage was changed to $-200$ V. A red recorded image having a reflection density of 0.57 (a green filter was used) was obtained.

EXAMPLE 14

A recording material was prepared in the same manner as in Example 13 except that Tetrazolium Blue or Neotetrazolium Chloride was used instead of the tetrazolium salt used in Example 13, and the recording operation was carried out by using this recording material to obtain a blue or violet recorded image having a reflection density of 0.52 (a red filter was used) or 0.48 (no filter was used).

What we claims is:

1. An electrically conductive composition for an electro-responsive recording material, which comprises a protonically conductive compound which is a solid electrolyte having a proton as the mobile ion, a finely divided inorganic solid acid having characteristics of a Bronstead acid or Lewis acid and a binder which is a water-soluble water-dispersible or organic solvent-soluble organic polymer, wherein the mixing weight ratio of the protonically conductive compound to the finely divided inorganic solid acid is in the range of from 0.5:100 to 100:100 and the amount of the binder is 10 to 500% by weight based on the total amount of the protonically conductive compound and finely divided inorganic solid acid.

2. An electrically conductive composition as set forth in claim 1 wherein the protonically conductive compound has an electric resistance lower than $1\times10^{13}$ $\Omega$-cm in the absolutely dry state.

3. An electrically conductive composition as set forth in claim 1 wherein the protonically conductive compound is an acid addition salt of an organic base.

4. An electrically conductive composition as set forth in claim 3 wherein the organic base satisfies at least one of the following two requirements:

(i) the ratio (C/N) of the number of carbon atoms to the number of nitrogen atoms in the range of from 0 to 8 and (ii) the first stage base dissociation constant (pKb) is in the range of from 0.3 to 8, as measured at 20° C.

5. An electrically conductive composition as set forth in claim 3 wherein the acid of said acid addition salt is an inorganic or organic acid having a first stage acid dissociation constant (pKa) not higher than 6.5, as measured at 25° C.

6. An electrically conductive composition as set forth in claim 1 wherein the finely divided inorganic solid acid has an adsorbing property characterized by a specific surface area of at least 50 $m^2/g$.

7. An electrically conductive composition as set forth in claim 1 wherein the finely divided solid acid is a fine powder of a clay mineral, acid-treated clay mineral, amorphous silica or hydrogen ion type zeolite.

8. An electrically conductive composition as set forth in claim 1 wherein the binder is a water-soluble organic polymer binder.

9. An electrically conductive composition as set forth in claim 1 wherein the binder is a water-dispersible organic polymer binder.

10. An electrically conductive composition as set forth in claim 1 wherein the binder is an organic solvent-soluble organic polymer binder.

11. An electrically conductive composition as set forth in claim 1 wherein the binder is an aqueous emulsion type carboxyl group-containing polymer.

12. An electrically conductive composition as set forth in claim 11 wherein the carboxyl group-containing polymer has an acid value of 1 to 30.

13. A composition for formation of an electrically conductive recording layer, which comprises (A) a protonically conductive compound which is a solid electrolyte having a proton as the mobile ion, (B) a finely divided inorganic solid acid having characteristics of a Bronstead acid or Lewis acid (C) a binder which is a water-soluble, water-dispersible or organic solvent-soluble organic polymer, and (D) a color former capable of color formation by introduction of different ions, discharge of ions, oxidation or reduction, change of the pH or Joule's heat, wherein the mixing weight ratio of the protonically conductive compound to the finely divided inorganic solid acid is in the range of from 0.5:100 to 100:100, the amount of the binder is 10 to 500% by weight based on the total amount of the protonically conductive compound and finely divided inorganic solid acid, and the color former is present in an amount of 2 to 40% by weight based on the total amount of the protonically conductive compound, finely divided inorganic solid acid and binder.

14. A composition as set forth in claim 13 wherein the color former is a tetrazolium salt.

15. A composition as set forth in claim 13 wherein the binder is an aqueous emulsion type carboxyl group-containing polymer.

16. An electrically conductive composition as set forth in claim 4 wherein the ratio C/N is in the range of from 1 to 4 and the first stage base dissociation constant (pKb) is in the range of from 2 to 6, as measured at 20° C.

17. An electrically conductive composition as set forth in claim 5 wherein the first stage acid dissociation constant (pKa) is not higher than 5, as measured at 25° C.

18. An electrically conductive composition as set forth in claim 4 wherein said organic base of the protonically conductive compound is selected from the group consisting of aliphatic amines, alicyclic amines, aromatic amines, heterocyclic amines, hydrazine and its derivatives, guanidine and its derivatives, and imines; and said finely divided inorganic solid acid is selected from the group consisting of natural clay minerals, activated clay minerals, amorphous silica, active alumina, silica-alumina, silica-magnesia, silica-boria, zeolites, solid phosphates, and amorphous titanium oxide.

19. An electrically conductive composition as set forth in claim 8 wherein the water-soluble organic polymer binder is selected from the group consisting of starch, cyanoethylated starch, methyl cellulose, ethyl cellulose, hydroxyethyl cellulose, carboxymethyl cellulose, tragacanth gum, gum arabic, glue, casein, gelatin, sodium alginate, polyvinyl alcohol, partially saponified polyvinyl acetate, partially acetalized polyvinyl alcohol, polyvinyl methyl ether, polyvinyl pyrrolidone, polyacrylamide, water-soluble acrylic resins, and mixtures thereof.

20. An electrically conductive composition as set forth in claim 9 wherein the water-dispersible organic polymer binder is selected from the group consisting of aqueous emulsions and latices of polyvinyl alcohol, polyvinyl chloride, polyvinylidene chloride, vinyl chloride-vinyl acetate copolymers, styrene-butadiene copolymers, methyl methacrylate-butadiene copolymers, acrylic acid ester-styrene copolymers, polyethylene, polypropylene, ethylene-vinyl acetate copolymers, vinyl acetate-acrylic acid ester copolymers, acrylonitrile-butadiene copolymers and acrylonirile-styrene-butadiene copolymers.

21. An electrically conductive composition as set forth in claim 10 wherein the organic solvent-soluble organic polymer binder is selecteed from the group consisting of shellac, copal, rosin, drying oil-modified rosin, phenolic resin-modified rosin, epoxy resins, phenolic resins, amino resins, unsaturated polyester resins, silicone resins, xylene resins, bismaleimide resins, thermosetting acrylic resins, acetyl cellulose, polyvinyl acetate, polyvinyl butyral resins, thermo-plastic acrylic resins, styrene-butadiene copolymers, vinyl chloride-vinyl acetate copolymers, vinyl chloride-vinyl acetate-vinyl alcohol copolymers, vinyl chloride-vinyl acetate-maleic acid copolymers, styrene-acrylic acid ester copolymers, polyamide resins, ethylene-vinyl acetate copolymers, ionomers, cyclized rubbers, and mixtures thereof.

22. An electrically conductive composition as set forth in claim 12 wherein the carboxyl group-containing polymer is selected from the group consisting of acrylic acid-butadiene copolymer, acrylic acid-styrene-butadiene copolymer, maleic acid-methyl methacrylate-butadiene copolymer, crotonic acid-acrylonitrile-butadiene copolymer, methacrylic acid-ethylene-vinyl chloride copolymer, itaconic acid-styrene-butadiene copolymer, acrylic acid-vinyl acetate copolymer, methacrylic acid-ethyl acrylate-styrene copolymer, maleic acid-ethylene-vinyl acetate copolymer, methacrylic acid-ethyl acrylate-vinyl acetate copolymer, crotonic acid-vinyl toluene-butadiene copolymer, methacrylic acid-methyl methacrylate-styrene copolymer, and acrylic acid-ethylene-vinyl acetate copolymer.

23. An electrically conductive composition as set forth in claim 1 wherein the mixing weight ratio of the protonically-conductive compound to the finely divided inorganic solid acid is in the range of from 2:100 to 80:100.

24. An electrically conductive composition as set forth in claim 1 wherein the mixing weight ratio of the protonically-conductive compound to the finely divided inorganic solid acid in the range of from 5:100 to 50:100.

25. A composition as set forth in claim 13 wherein the protonically-conductive compound comprises an acid addition salt of an organic base wherein said organic base is selected from the group consisting of primary, secondary, and tertiary, aliphatic, alicyclic, aromatic and heterocyclic amines hydrazine and its derivatives, guanidine and its derivatives, and imines, said organic base satisfying at least one of the following two requirements: (i) the ratio (C/N) of the number of carbon atoms to the number of nitrogen atoms is in the range of from 0 to 8, and (ii) the first stage base dissociation constant (pKb) is in the range of from 0.3 to 8, as measured at 20° C.; said finely divided inorganic solid acid is selected from the group consisting of natural clay minerals, activated clay minerals, amorphous silica, active alumina, silica-alumina, silica-magnesia, silica-boria, zeolites, solid phosphates, and amorphous titanium oxide; and said color forming material is selected from the group consisting of:

(i) a chelating agent capable of reacting with a cation introduced from a metallic anode to form a color image,
(ii) a reducing agent capable of reacting with a cation introduced from a metallic anode to form an image of fine metallic particles,
(iii) potassium iodide and starch,
(iv) a leuco dye,
(v) a compound capable of being reduced in contact with an electrode to form a color image,
(vi) a diazonium salt,
(vii) a combination of aromatic primary amine, coupling component and alkali metal nitrate,
(viii) a leuco dye and an organic substance,
(ix) a metal salt of a long-chain fatty acid and phenol,
(x) a combination of a metal of an organic acid with a metal sulfide or an organic chelating agent,
(xi) a noble metal salt of an organic acid and an aromatic reducing agent, and
(xii) a metal salt of a higher fatty acid and a zinc derivative of a di-substituted dithio carbamic acid.

26. A composition as set forth in claim 16 wherein the amount of the binder is 20 to 100% by weight, based on the total amount of the protonically conductive compound and finely divided inorganic solid acid.

27. The composition of claim 13 which further comprises a color developer and wherein the combined amount of the color former and color developer is from 2 to 40% by weight based on the total amount of the protonically conductive compound, finely divided inorganic solid acid and binder.

* * * * *

UNITED STATES PATENT AND TRADEMARK OFFICE

CERTIFICATE OF CORRECTION

PATENT NO. : 4,557,856

DATED : December 10, 1985

INVENTOR(S) : NOBUHIRO MIYAKAWA, ET AL.

It is certified that error appears in the above-identified patent and that said Letters Patent is hereby corrected as shown below:

IN THE CLAIMS

Claim 20, line 11, (column 21, line 44),
delete "acrylonirile", insert --acrylonitrile--.

Signed and Sealed this

*Eleventh* Day of *February 1986*

[SEAL]

*Attest:*

DONALD J. QUIGG

*Attesting Officer*

*Commissioner of Patents and Trademarks*